US007463208B2

(12) United States Patent
Araki et al.

(10) Patent No.: US 7,463,208 B2
(45) Date of Patent: Dec. 9, 2008

(54) ANTENNA, AND RADIO-CONTROLLED TIMEPIECE, KEYLESS ENTRY SYSTEM AND RFID SYSTEM

(75) Inventors: Hirokazu Araki, Kitamoto (JP); Chiharu Mitsumata, Takasaki (JP); Masahiro Mita, Fukaya (JP)

(73) Assignee: Hitachi Metals, Ltd., Tokyo (JP)

( * ) Notice: Subject to any disclaimer, the term of this patent is extended or adjusted under 35 U.S.C. 154(b) by 51 days.

(21) Appl. No.: 11/428,511

(22) Filed: Jul. 3, 2006

(65) Prior Publication Data

US 2007/0024516 A1 Feb. 1, 2007

(30) Foreign Application Priority Data

Jul. 4, 2005 (JP) ..... 2005-195057

(51) Int. Cl.
*H01Q 7/08* (2006.01)
*H01Q 1/00* (2006.01)

(52) U.S. Cl. ..... 343/787; 343/788; 343/718

(58) Field of Classification Search ..... 343/788, 343/787

See application file for complete search history.

(56) References Cited

U.S. PATENT DOCUMENTS

| | | | | |
|---|---|---|---|---|
| 7,088,304 | B2 * | 8/2006 | Endo et al. | 343/788 |
| 2005/0078045 | A1 * | 4/2005 | Sano | 343/788 |
| 2006/0152427 | A1 * | 7/2006 | Ueda et al. | 343/788 |
| 2007/0120758 | A1 * | 5/2007 | Takahashi | 343/788 |

FOREIGN PATENT DOCUMENTS

| | | |
|---|---|---|
| JP | 08-271659 | 10/1996 |
| JP | 2002-168978 | 6/2002 |
| JP | 2003-110341 | 4/2003 |
| JP | 2004-104551 | 4/2004 |

* cited by examiner

*Primary Examiner*—Trinh V Dinh
(74) *Attorney, Agent, or Firm*—Sughrue Mion, PLLC

(57) ABSTRACT

An antenna comprising a magnetic main-path member comprising a coil wound around a magnetic core, and a magnetic sub-path member magnetically connected to the magnetic core for constituting a substantially closed magnetic path with the magnetic main-path member, the antenna meeting the relation of $(S/N)_1>(S/N)_0$, wherein $(S/N)_1$ is a ratio of a signal voltage S obtained from the coil to a noise voltage N in this antenna, and $(S/N)_0$ is a ratio of a signal voltage S to a noise voltage N in an antenna having the same structure except for having no magnetic sub-path member.

11 Claims, 8 Drawing Sheets

ANTENNA, AND RADIO-CONTROLLED TIMEPIECE, KEYLESS ENTRY SYSTEM AND RFID SYSTEM

FIELD OF THE INVENTION

The present invention relates to a magnetic sensor-type antenna suitable for radio-controlled timepieces receiving electromagnetic waves including time information for time adjustment, smart keyless entry systems for detecting the access of owners by electromagnetic waves to open keys of automobiles or a houses, etc., or RFID tag systems for giving and receiving information by modulation signals carried by electromagnetic waves, etc., and a radio-controlled timepiece, a keyless entry system and an RFID system comprising such magnetic sensor-type antenna.

BACKGROUND OF THE INVENTION

Radio-controlled timepieces receiving radio waves including time information to adjust its own time based on that time information have been finding various applications such as clocks, wristwatches, etc. Used for the radio-controlled timepieces are long-wavelength radio waves of 40-200 kHz, particularly two frequencies of 40 kHz and 60 kHz in Japan and frequencies of 100 kHz or less mainly overseas. Although antennas as long as more than several hundreds of meters are needed to receive these radio waves efficiently, such long antennas cannot be used in wristwatches, keyless entry systems, RFID systems, etc. Generally used are thus magnetic sensor-type antennas comprising coils wound around magnetic cores, thereby exhibiting the same functions as those of long antennas.

A wristwatch is mainly constituted by a housing, a movement (driver module) and its peripheral parts (dial, motor, battery, etc.), a non-metal (glass) cover, and a rear metal cover. When an antenna is contained in a wristwatch, it is conventionally disposed outside the housing in many cases. However, the recent trend of increasing design appeal and reducing size and weight has required an antenna to be disposed in a housing. FIG. 12 shows one example of wristwatches containing an antenna in a housing 21. A movement 22 and peripheral parts 26 such as a battery, a motor for moving a pointer, etc. are disposed in the housing 21, and an antenna 1 is placed in a space defined by the housing 21, the movement 22, the peripheral parts 26 and the rear cover 24. The antenna 1 is shown by a solid line to clearly indicate its position, though the antenna 1 is actually not seen in the front view of FIG. 12.

JP 2003-110341 A discloses a small antenna for a radio-controlled timepiece comprising a magnetic core constituted by an amorphous metal laminate, and a coil wound around it. JP 8-271659 A discloses a small antenna comprising a magnetic core made of ferrite and a coil wound around it. Design is generally important for wristwatches, and their housings are preferably made of metals to have high-quality and decorative appearance. However, when the small antenna described in JP 2003-110341 A or JP 8-271659 A is mounted in a wristwatch with a metal housing, the metal housing acts as a shield to electromagnetic waves, resulting in drastically reduced receiving sensitivity.

JP 2002-168978 A discloses an antenna comprising a conductive seal member between a metal case and an antenna to keep a Q value. However, because the seal member is indispensable, it suffers restrictions in size reduction and design.

Japanese Patent 3,512,782 discloses an antenna comprising a main magnetic path comprising a coil wound around a magnetic core, and a magnetic sub-path comprising a magnetic core without a coil, an air gap being provided in part of a closed magnetic loop constituted by both magnetic cores, such that magnetic fluxes generated during resonance are less likely to leak outside. The antenna of Japanese Patent 3,512,782 selectively guides magnetic fluxes during resonance to the magnetic sub-path, thereby making the magnetic fluxes less likely to leak outside to suppress the reduction of a Q value due to an eddy current loss. However, the antenna of this structure suffers the problem that its S/N ratio is lowered even though the magnetic sub-path suppresses the reduction of the Q value. A lower S/N ratio leads to a higher error ratio of the received time information.

The keyless entry system enabling the remote operation of a key for a vehicle, etc. comprises a transmitting/receiving unit mounted to a vehicle equipped with an antenna for particular electromagnetic waves, and a transmitting/receiving unit (remote key) owned by a driver. In the keyless entry system, the vehicle-mounted transmitting/receiving unit periodically calls at a low frequency, and when a driver carrying a remote key with ID equal to the system enters into a transmittable area, the transmitting/receiving unit contained in the remote key returns encrypted ID in a UHF band to the vehicle to open the lock of the vehicle.

The radio frequency identification (RFID) system supplies and receives information stored in a tag via an antenna for predetermined electromagnetic waves. The RFID system comprises a transponder attached to an object, an interrogator, a computer, etc. The transponder, which is called "RFID tag," comprises a memory for storing information, a wireless transmitting/receiving means for communicating with the interrogator wirelessly, and an antenna. The interrogator called "RFID reader/writer" transmits and receives an information-carrying carrier wave (radio wave or magnetic field) to and from the transponder to read the information of the transponder and write the information in the transponder. It comprises a controller for treating instructions from the computer, a wireless transmitting/receiving means for communicating with the transponder wirelessly, and an antenna. The information read by the interrogator is conveyed to a data-treating means such as a computer and used for managing the objects. The features of the RFID system are that because it reads and writes information without contact using radio waves (electromagnetic waves), dust and stain attached to the object are less likely to affect the reading and writing, that communication can be made even with obstacles except for metals, etc. between the interrogator and the transponder, and that simultaneous access is possible to pluralities of transponders in an RF field. The antenna of the present invention can be used as a receiving antenna in the transponder.

For instance, when an RFID tag, to which destination information, etc. are input, is mounted to a bus, etc., and when an RFID tag, to which timetable information is input, is embedded in a display board, etc. at a bus stop, various transportation information can be seen. Because such keyless entry systems and RFID systems comprise magnetic sensor-type antennas in metal housings or near metal parts, they also suffer the problem that the metal hinders the receiving of radio waves. Accordingly, the size reduction and sensitivity increase of an antenna are also required in these systems.

OBJECTS OF THE INVENTION

Accordingly, an object of the present invention is to provide a small magnetic sensor-type antenna having high sensitivity and a high S/N ratio.

Another object of the present invention is to provide a radio-controlled timepiece (particularly, a radio-controlled wristwatch), a keyless entry system and an RFID system each comprising such a magnetic sensor-type antenna.

DISCLOSURE OF THE INVENTION

As a result of intense research in view of the above objects, the inventors have found that in a magnetic sensor-type antenna comprising a magnetic main-path member comprising a coil wound around a magnetic core, and a magnetic sub-path member magnetically connected to the magnetic core for constituting a substantially closed magnetic path with the magnetic main-path member, high sensitivity and a high S/N ratio can be achieved by adjusting a ratio of the magnetic sub-path member to the magnetic core in a cross section area and relative permeability. The present invention has been completed based on this finding.

Thus, the antenna of the present invention comprises a magnetic main-path member comprising a coil wound around a magnetic core, and a magnetic sub-path member magnetically connected to the magnetic core for constituting a substantially closed magnetic path with the magnetic main-path member, the antenna meeting the relation of $(S/N)_1>(S/N)_0$, wherein $(S/N)_1$ is a ratio of a signal voltage S obtained from the coil to a noise voltage N in this antenna, and $(S/N)_0$ is a ratio of a signal voltage S to a noise voltage N in an antenna having the same structure except for having no magnetic sub-path member.

The magnetic core is preferably made of at least one selected from the group consisting of ferrite, amorphous alloys, magnetic, nanocrystalline Fe—Cu—Nb—Si—B alloys, and magnetic Fe—Si alloys.

The magnetic sub-path member is preferably formed by a flexible magnetic composite comprising at least one selected from the group consisting of soft-magnetic ferrite powder, soft-magnetic metal powder and soft-magnetic metal flake, and a resin and/or a rubber.

The magnetic sub-path member preferably has a lower relative permeability than that of the magnetic core. The magnetic sub-path member preferably has relative permeability of 1-100.

The magnetic sub-path member preferably has a smaller cross section area than that of the magnetic core.

The radio-controlled timepiece of the present invention comprises a metal housing, a movement, a non-metal cover and a rear metal cover, further containing the above antenna.

In the above radio-controlled timepiece, the antenna is preferably disposed such that the magnetic sub-path member is positioned on the side of the housing.

The radio-controlled timepiece of the present invention is preferably a radio-controlled wristwatch.

The keyless entry system of the present invention comprises a transmitter and a receiver, the transmitter and/or the receiver containing the above antenna.

The RFID system of the present invention comprises an RFID tag containing the above antenna.

BRIEF DESCRIPTION OF THE DRAWINGS

FIG. 1(*b*) is an exploded side view showing the antenna of FIG. 1(*a*) when viewed from A.

FIG. 4(*b*) is a side view showing the antenna of FIG. 4(*a*) when viewed from A.

FIG. 5(*b*) is a cross-sectional view taken along the line B-B in FIG. 5(*a*).

FIG. 12(*b*) is a side view showing the radio-controlled wristwatch of FIG. 12(*a*).

DESCRIPTION OF THE PREFERRED EMBODIMENTS

[1] Structure of antenna

Figure 1A:
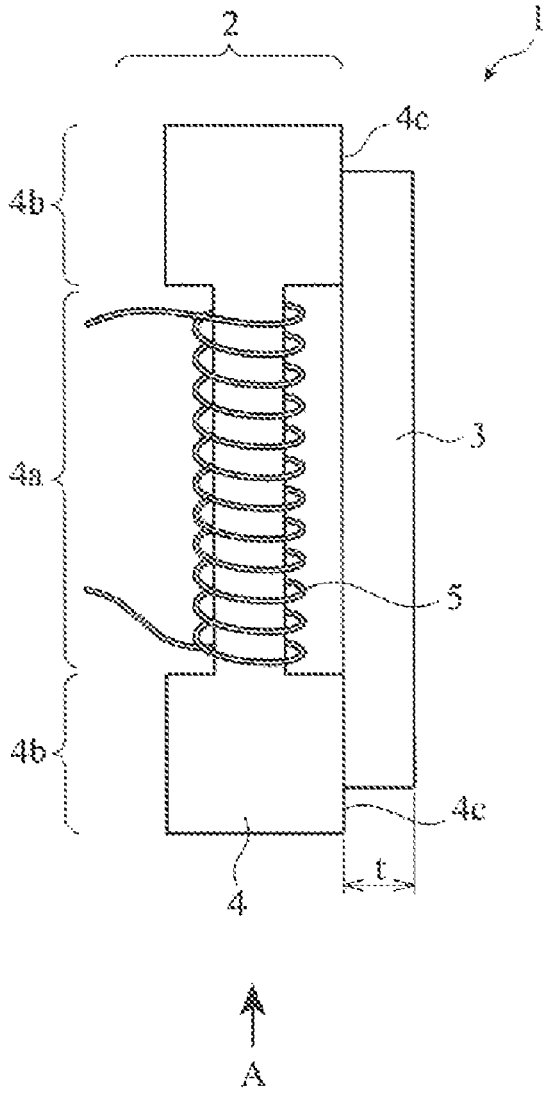
FIG. 1(*a*) is a front view showing an antenna according to a preferred embodiment of the present invention.
Figure 1B:
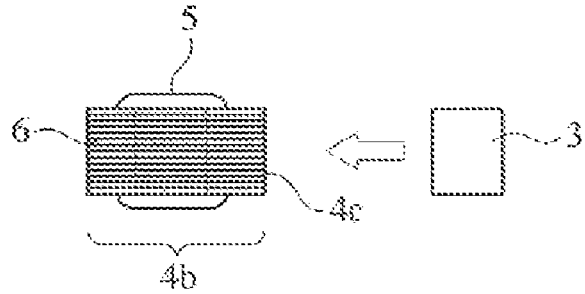

FIGS. 1(*a*) and 1(*b*) show an antenna 1 according to a preferred embodiment of the present invention. Incidentally, a bobbin, etc. are omitted to clearly show the structure of the antenna 1. The antenna 1 comprises a magnetic main-path member 2 comprising a coil 5 wound around a magnetic core 4, and a magnetic sub-path member 3 magnetically connected to the magnetic main-path member 2 for forming a closed magnetic path.

(1) Magnetic main-path member

The magnetic core 4 of the magnetic main-path member 2 preferably has a dumbbell shape comprising a center portion 4*a* having a smaller cross section, to which the magnetic sub-path member 3 is attached, and both end portions 4*b*, 4*b* each having a larger cross section. The magnetic core 4 is preferably made of soft-magnetic ferrite, or soft-magnetic metals such as amorphous alloys, nanocrystalline, magnetic Fe—Cu—Nb—Si—B alloys, magnetic Fe—Si alloys, etc. In the case of the soft-magnetic metals, their ribbons (thickness: 20 μm or less) are preferably cut to dumbbell-shaped, thin plates 6, and integrally laminated to 30-40 layers via insulators. The magnetic core 4 preferably has as high relative permeability as possible. For instance, the relative permeability of the magnetic core 4 is preferably 100 or more, more preferably 500-100000. The coil 5 wound around the center portion 4*a* of the magnetic core 4 is preferably in about 800-1400 turns.

(2) Magnetic sub-path member

The magnetic sub-path member 3 attached to side surfaces 4*c*, 4*c* of both end portions 4*b*, 4*b* of the magnetic core 4 without air gaps may be in the form of a rod, a plate or a wire. In order to have smaller relative permeability than that of the magnetic core 4, the magnetic sub-path member 3 is preferably made of a composite comprising soft-magnetic powder such as soft-magnetic ferrite powder, nanocrystalline, soft-magnetic metal powder or flake, etc., and a binder of a resin, a rubber, etc. The nanocrystalline, soft-magnetic metal powder or flake can be obtained by forming amorphous alloy powder by an atomizing method, a cavitation method, etc., flattening the powder by a ball mill or an attrition mill, and turning it to nanocrystalline by a heat treatment. The preferred resins are silicone resins, acrylic resins, vinyl chloride resins, phenol resins, etc., and the preferred rubbers are chloroprene rubbers, butyl rubbers, urethane rubbers, etc. The composite can be controlled to have desired relative permeability by adjusting a mass ratio of the soft-magnetic powder to the binder. The mass ratio of the soft-magnetic powder to the binder is preferably small when the soft-magnetic powder has large relative permeability, and large when the soft-magnetic powder has small relative permeability. A flexible (soft) magnetic composite containing a flexible (soft) binder is easy to handle and has high impact strength and good workability because of flexibility, so that it is easily disposed in an air gap. The present invention is not limited to use one magnetic sub-path member 3 but may use pluralities of magnetic sub-path members 3.

The magnetic sub-path member 3 preferably has lower relative permeability than that of the magnetic core 4. Specifically, the magnetic sub-path member 3 preferably has relative permeability of 1-100. When the relative permeability of the magnetic sub-path member 3 exceeds 100, the magnetic fluxes are less likely to be concentrated in the main magnetic path. The relative permeability of the magnetic sub-path member 3 is more preferably 5-100, most preferably 10-60.

When the relative permeability of the magnetic sub-path member 3 is lower than that of the magnetic core 4, though higher than the relative permeability of air, most of the received magnetic fluxes flow through the magnetic core 4, having part of the magnetic fluxes flow through a closed magnetic path passing through the magnetic sub-path member 3. With the magnetic fluxes separately flowing through the magnetic core 4 and the magnetic sub-path member 3 like this, high signal voltage can be obtained.

Because part of the magnetic fluxes received by the antenna 1 return to the magnetic core 4 of the magnetic main-path member 2 via the magnetic sub-path member 3, effectively increased amounts of magnetic fluxes flow through the coil 5. However, when larger amounts of magnetic fluxes flow through the magnetic sub-path member 3, smaller amounts of magnetic fluxes flow through the magnetic core 4. Accordingly, the amount of magnetic fluxes flowing through both members should be controlled within an optimum range. Thus, the magnetic sub-path member 3 preferably has a smaller cross section area than that of the magnetic core 4. Incidentally, the cross section area of the magnetic core 4 is determined by the cross section area of the center portion 4*a* . Though changeable depending on their relative permeability ratio, the cross section area ratio of the magnetic sub-path member 3 to the magnetic core 4 is generally 1/10000-1/2, preferably 1/1000-1/2, more preferably 1/100-1/3, particularly 1/10-1/5. Within this range of the cross section area ratio, a large amount of magnetic fluxes pass through the coil 5.

The amount of magnetic fluxes flowing through the magnetic sub-path member 3 varies depending on the material, shape and dimension of the housing containing the antenna 1. Accordingly, taking into consideration their influences, the relative permeability and cross section area of the magnetic sub-path member 3, and the contact area of the magnetic sub-path member 3 with the magnetic core 4 of the magnetic main-path member 2, etc. are properly adjusted.

(3) S/N ratio

The S/N ratio of the signal voltage S obtained by the electric resonance of the coil 5 to the noise voltage N should meet the relation of $(S/N)_1>(S/N)_0$, wherein $(S/N)_1$ represents the S/N ratio of the antenna of the present invention comprising the magnetic sub-path member 3, and $(S/N)_0$ represents the S/N ratio of an antenna having the same structure except for comprising no magnetic sub-path member 3. Incidentally, the S/N ratio is a value obtained by 20×log (S/N). When the relation of $(S/N)_1>(S/N)_0$ is met, the antenna has high Q value, signal voltage S and S/N ratio.

It has been found that the S/N ratio depends on the specific permeability ratio and cross section area ratio of the magnetic sub-path member 3 to the magnetic core 4. To obtain the S/N ratio meeting the relation of $(S/N)_1>(S/N)_0$, the relative permeability ratio is preferably in a range of $(0.05\text{-}200)\times10^{-3}$, more preferably in a range of $(0.1\text{-}100)\times10^{-3}$, and the cross section area ratio is 1/10000-1/2, preferably 1/1000-1/2, more preferably 1/100-1/3, particularly 1/50-1/5.

[2] Radio-controlled timepiece containing antenna

Figure 2:
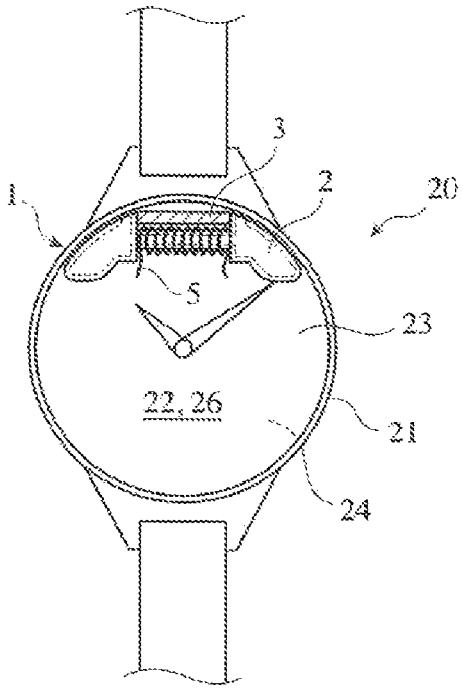
FIG. 2 is a front view showing an example in which the antenna of the present invention is disposed in a wristwatch.

FIG. 2 shows one example of a radio-controlled wristwatch 20 containing the antenna of the present invention. The radio-controlled wristwatch 20 comprises a metal (for instance, stainless steel) housing 21, a movement 22 and peripheral parts 26 disposed therein, a glass cover 23, a rear metal (for instance, stainless steel) cover 24, and an antenna 1 disposed between the movement 22 and the rear cover 24. Incidentally, the antenna 1 is indicated by a solid line to clarity its position, though it is actually not seen from the front.

Because the magnetic sub-path member 3 formed by a flexible magnetic composite has easily controllable thickness and area, it can be arranged along an inner wall of the metal housing 21, resulting in the antenna with increased degree of design freedom and easily controllable sensitivity. Alternatively, when the magnetic main-path member 2 is arranged on the side of the peripheral portion of the metal housing 21, an external magnetic field tends to be focused in the magnetic core 4 near the metal housing 21, and a magnetic field leaking from the magnetic sub-path member 3 distant from the metal housing 21 is less likely to reach the housing 21, so that eddy current is scarcely generated. Taking into consideration these advantages and disadvantages, the arrangement of the antenna 1 in the metal housing 21 should be properly determined.

[3] Other uses

Figure 3:
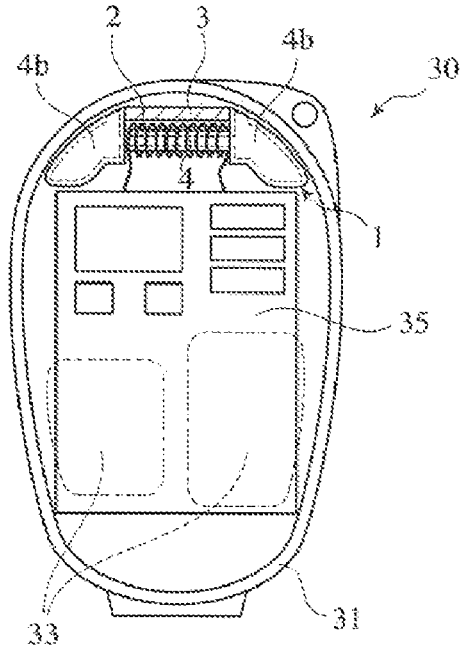
FIG. 3 is a cross-sectional view showing a key body for a keyless entry system, which contains the antenna of the present invention.

In addition to the above, the antenna of the present invention is suitable for keyless entry systems for the remote operation of keys for vehicles, houses, etc., and RFID systems for supplying and receiving information using information-storing tags. FIG. 3 shows a key body 30 for a keyless entry system, a type of RFID tags comprising the antenna of the present invention. In FIG. 3, the antenna 1 is indicated by a solid line to clarify its position. The key body 30 mainly comprises a resin housing 31, key-switching buttons 33, a transmitting/receiving circuit substrate 35, and an antenna 1. Each end portion 4*b*, 4*b* of a magnetic core 4 of a magnetic main-path member 2 in the antenna 1 has a circular peripheral surface complementary to the inner surface of the housing 31. The antenna 1 has a magnetic sub-path member 3 on the side of the housing 31 to effectively use a space in the key body 30. Because the antenna is contained in a metal housing or together with metal parts in a non-metal housing in the keyless entry system and the RFID system, like the radio-controlled timepiece, the antenna of the present invention is suitable.

The present invention will be explained in more detail referring to Examples below without restrictive intention.

EXAMPLE 1

Figure 4A:
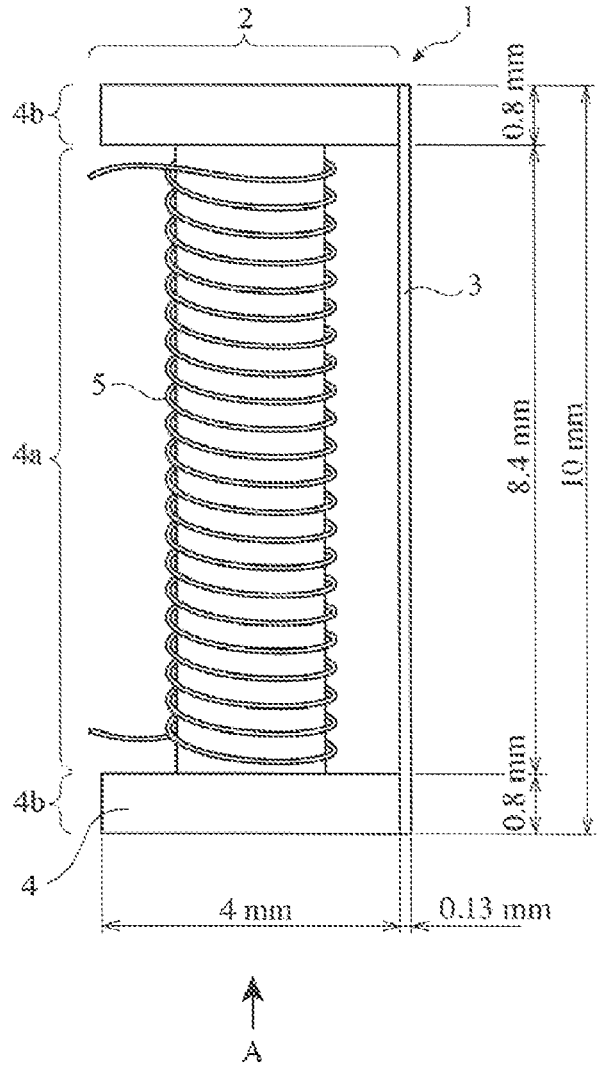
FIG. 4(*a*) is a front view showing the antenna of Example 1.
Figure 4B:
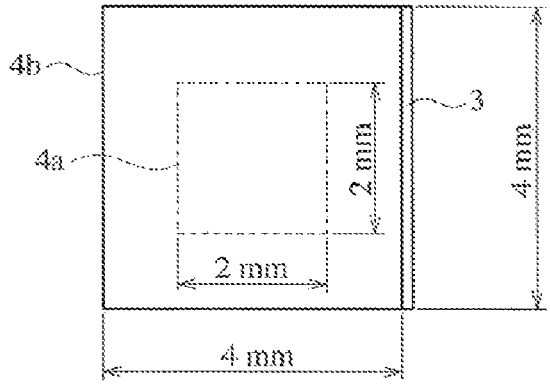

An antenna 1 comprising a magnetic main-path member 2 and a magnetic sub-path member 3 as shown in FIGS. 4(*a*) and 4(*b*) was produced as follows. The magnetic main-path member 2 comprised a magnetic core 4 made of Mn—Zn ferrite (relative permeability: 7000, Ferrite MT80D available from Hitachi Metals, Ltd.), and machined to have a center portion 4*a* (2 mm each, and 8.4 mm long) and end portions 4*b*, 4*b* (4 mm each, and 0.8 mm long) on both sides thereof, and a coil 5 of a 65-μm-thick, enameled copper wire wound around the center portion 4*a* by 1180 turns. The magnetic sub-path member 3 was produced by forming a 0.13-mm-thick sheet from a mixture (relative permeability: 8.5) of 45% by volume of high-permeability, nanocrystalline, soft-magnetic metal flake (FINEMET® available from Hitachi Metals, Ltd.) having a thickness of 1 μm and an average diameter of 35 μm, 11% by volume of an ethylene-methyl acrylate copolymer and 23% by volume of polyethyl acrylate as binder resins, and 20% by volume of magnesium hydroxide and 1% by volume of red phosphorus as flame retardants, and cutting the sheet to a size of 4 mm in width and 10 mm in length. This magnetic sub-path member 3 was attached to one side of each end portion 4*b*, 4*b* of the magnetic core 4. The thickness t of the magnetic sub-path member 3 is shown in Table 1.

Figure 5A:
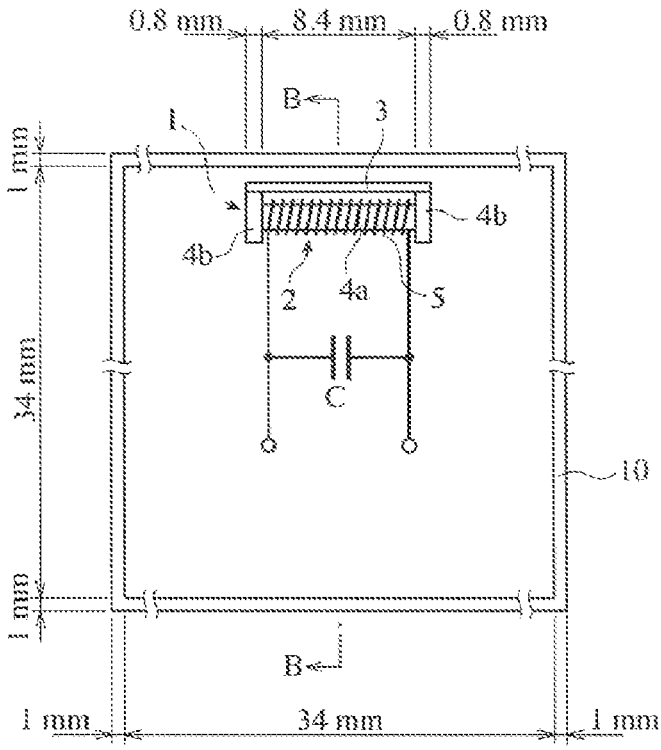
FIG. 5(*a*) is a front view showing the structure and dimension of a test apparatus.
Figure 5B:
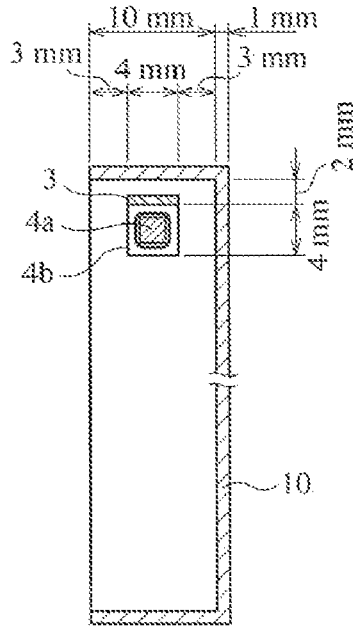

As shown in FIGS. 5(*a*) and 5(*b*), the antenna 1 was disposed in a 1-mm-thick metal case 10 made of stainless steel (SUS403) and having a shape and a size similar to those of the housing 21 of the radio-controlled wristwatch 20, such that the magnetic sub-path member 3 was adjacent to a side wall of the metal case 10, to constitute a test apparatus for detecting voltage V by the coil 5 in magnetic fluxes changing with time. Incidentally, the antenna 1 was placed on a non-magnetic table (not shown) at a position of 3 mm and 2 mm, respectively, from the bottom and side surfaces of the metal case 10.

Figure 6:
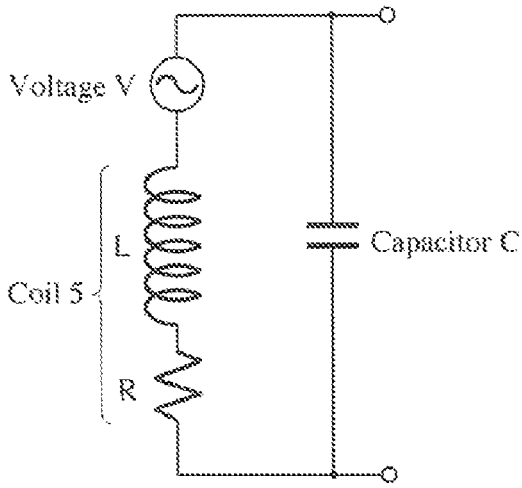
FIG. 6 is a view showing an equivalent circuit of the test apparatus shown in FIG. 5.

FIG. 6 shows the equivalent circuit of this test apparatus. L represents the inductance of the coil 5 wound around the magnetic core 4, and R represents a sum of DC resistance and alternating resistance of the coil 5. A capacitor C parallel-connected to the antenna 1 resonates with L of the coil 5, generating Q-times voltage at both ends of the capacitor C. A Q value is a value defined by $\omega L/R$, wherein $\omega$ is an angular frequency of an electromagnetic wave, R is the resistance of the coil 5, and L is the self-inductance of the coil 5. The larger the Q value, the smaller the electric power loss.

Figure 7:
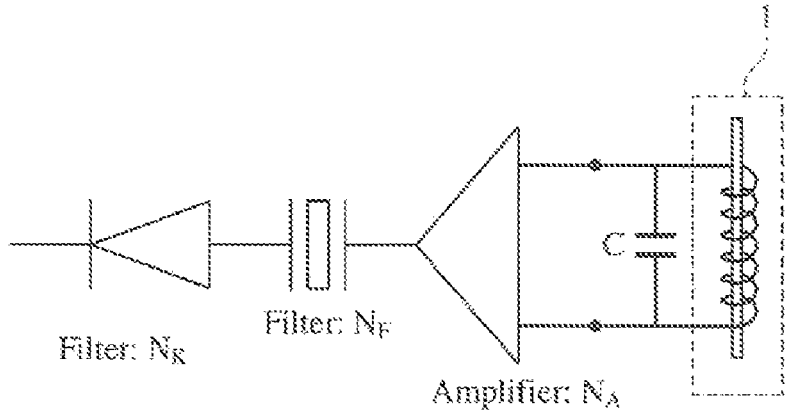
FIG. 7 is a block diagram showing an electronic circuit connected to the antenna.
Figure 8:
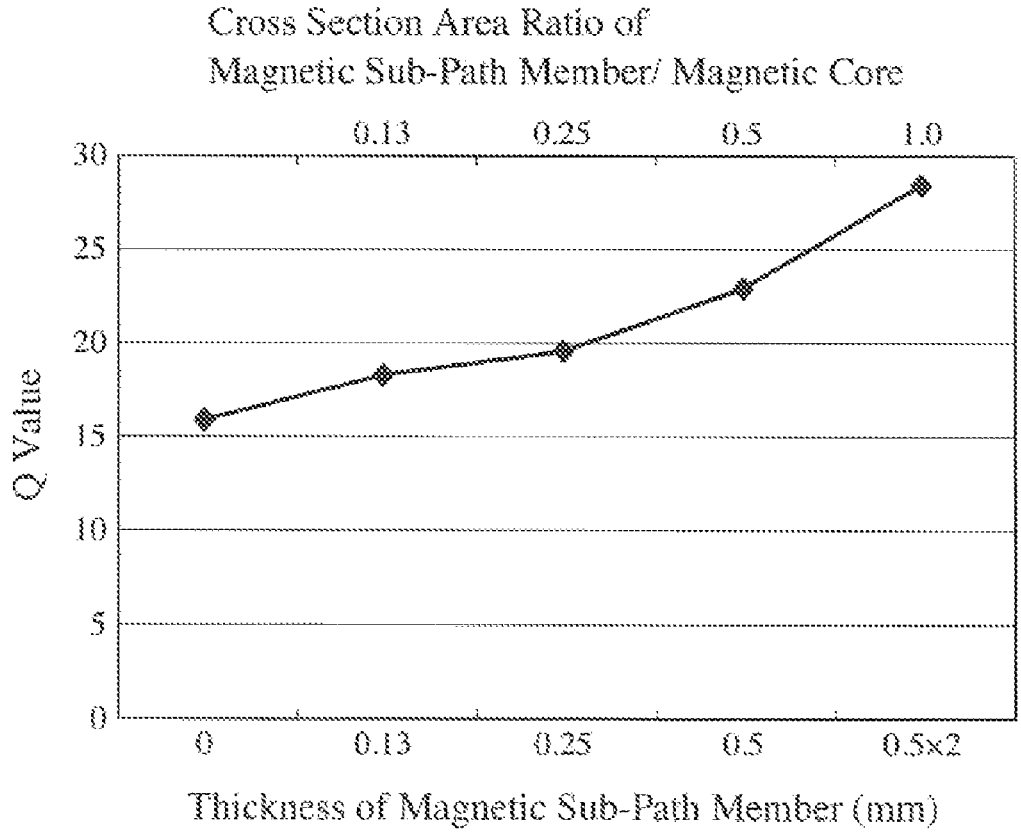
FIG. 8 is a graph showing the relation between the thickness of the magnetic sub-path member and a cross section area ratio of the magnetic sub-path member to the magnetic core, and a Q value in the antenna of the present invention.
Figure 9:
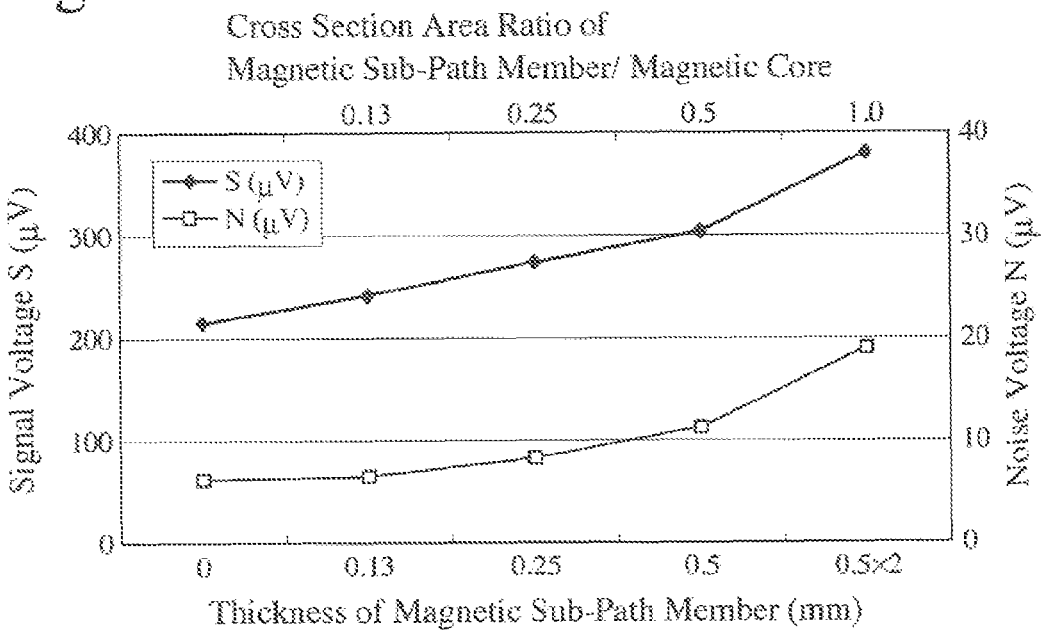
FIG. 9 is a graph showing the relation between the thickness of the magnetic sub-path member and a cross section area ratio of the magnetic sub-path member to the magnetic core, and a signal voltage and a noise voltage in the antenna of the present invention.
Figure 10:
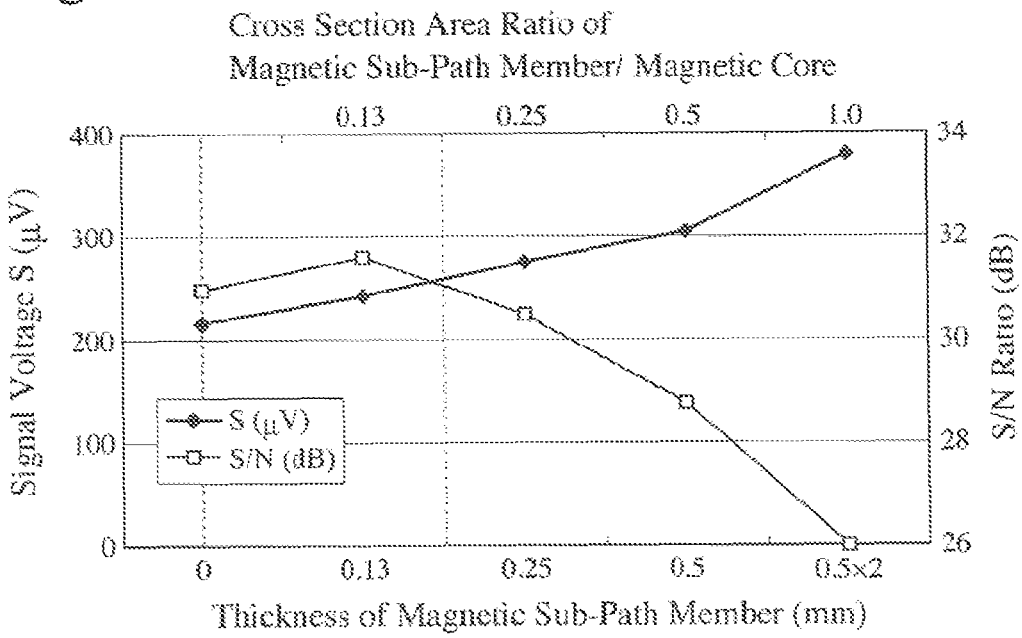
FIG. 10 is a graph showing the relation between the thickness of the magnetic sub-path member and a cross section area ratio of the magnetic sub-path member to the magnetic core, and a signal voltage and an S/N ratio in the antenna of the present invention.

A magnetic field having a frequency of 40 kHz and a magnetic field intensity of 14 pT is applied to the antenna 1 from outside the metal case 10, as an effective alternating magnetic field corresponding to the magnetic field component of the electromagnetic wave, and resonance was caused by adjusting the capacitance of the capacitor C to measure a signal voltage S (sensitivity), a noise voltage N and a Q value by a Lock-in-Amp method shown in FIG. 7. The Lock-in-Amp method is a method for accurately measuring antenna characteristics in the same electric environment as in a radio-controlled timepiece with the antenna 1 connected to an electronic circuit equivalent to that of the radio-controlled timepiece. The results are shown in FIGS. 8-10.

EXAMPLE 2-4

Figure 11:
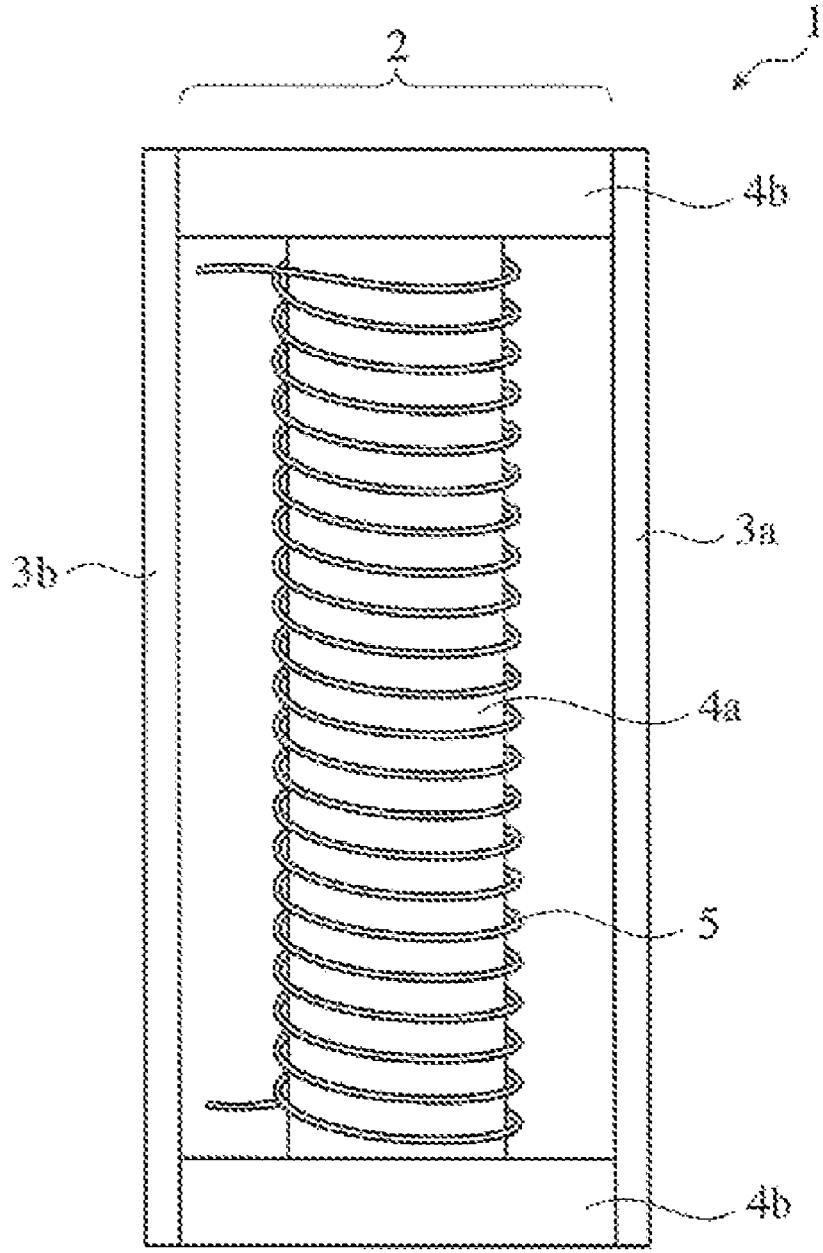
FIG. 11 is a front view showing the antenna of Example 4.
Figure 12A:
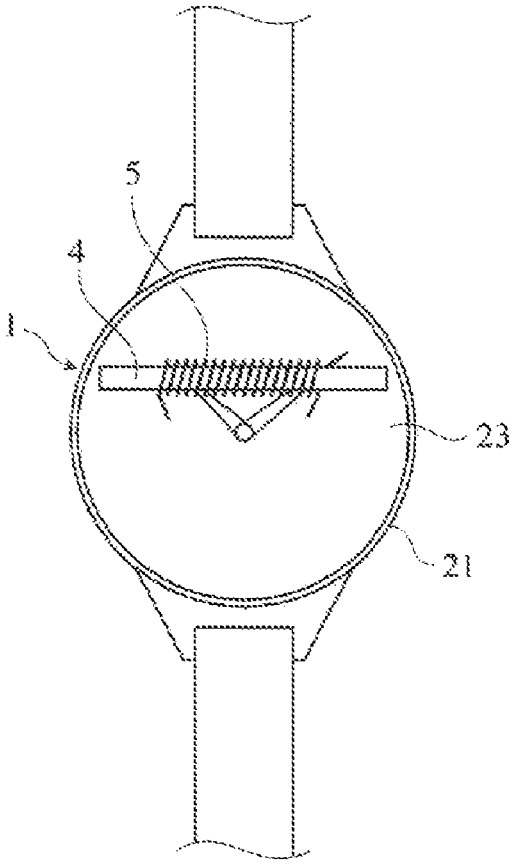
FIG. 12(*a*) is a front view showing a radio-controlled wristwatch containing a conventional antenna.
Figure 12B:
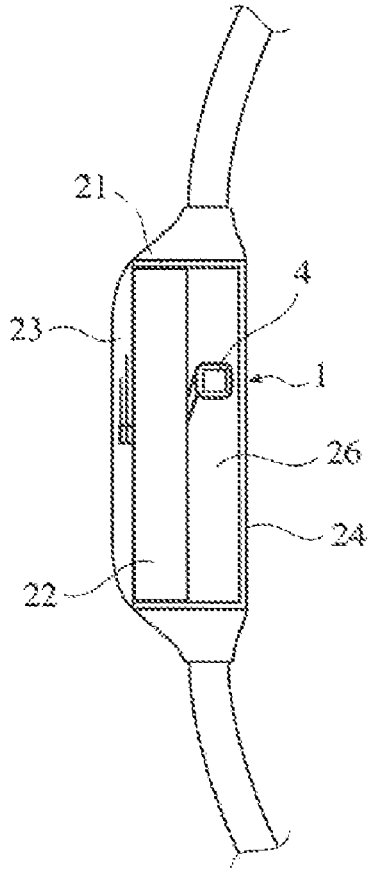

Antennas were produced in the same manner as in Example 1 except for changing the thickness t of the magnetic sub-path member 3 as shown in Table 1. In Example 4, two 0.5-mm-thick magnetic sub-path members 3*a*, 3*b* were attached to both sides of the end portions 4*b*, 4*b* of the magnetic core 4 as shown in FIG. 11. The Q value, the signal voltage S, the noise voltage N and the S/N ratio were measured in the same manner as in Example 1. The results are shown in FIGS. 8-10.

COMPARATIVE EXAMPLE 1

An antenna was produced in the same manner as in Example 1 except for attaching no magnetic sub-path member 3. The Q value, the signal voltage S, the noise voltage N and the S/N ratio were measured in the same manner as in Example 1. The results are shown in FIGS. 8-10.

TABLE 1

| No. | Thickness t of Magnetic Sub-Path Member |
|---|---|
| Comparative Example 1 | 0 mm(1) |
| Example 1 | 0.13 mm |
| Example 2 | 0.25 mm |
| Example 3 | 0.5 mm |
| Example 4 | 0.5 mm × 2(1) |

Note:
(1)No magnetic sub-path member.
(2)Two 0.5-mm-thick magnetic sub-path members.

It is clear from FIG. 8 that as the magnetic sub-path member 3 became thicker, the Q value increased. This appears to be due to the fact that alternating resistance caused by eddy current loss generated when magnetic fluxes generated from the antenna 1 flew through the metal housing was reduced by returning part of the magnetic fluxes to the magnetic core 4 through the magnetic sub-path member 3. However, as is clear from FIG. 9, the magnetic sub-path member 3 became thicker, not only the signal voltage S but also the noise voltage N increased. As is clear from FIG. 10, in which S/N ratios [20×log (S/N)] determined from the signal voltage S and the noise voltage N were plotted, the antenna of Example 1 comprising a 0.13-mm-thick magnetic sub-path member 3 exhibited the highest S/N ratio.

The comparison of Examples 1-4 revealed that too thick a magnetic sub-path member 3 rather decreases the S/N ratio. It is thus clear that an optimum combination of the Q value, the signal voltage and the S/N ratio can be obtained by properly adjusting the thickness of the magnetic sub-path member 3. As a result, it was found that to obtain excellent Q value and signal voltage and a high S/N ratio, the thickness t of the magnetic sub-path member (the cross section area ratio of the magnetic sub-path member to the magnetic core) may be more than 0 mm and about 0.2 mm or less (more than 0 and about 0.2 or less), when the specific permeability ratio of the magnetic sub-path member to the magnetic core is 0.0012. Incidentally, for the same adjustment, the contact area of the magnetic sub-path member 3 with the magnetic core 4 may be changed instead of adjusting the thickness (cross section area) of the magnetic sub-path member 3.

EFFECTS OF THE INVENTION

Because the antenna of the present invention receives external magnetic fluxes by a magnetic core in a magnetic main-path member, and guides radiating magnetic fluxes during resonance to a magnetic sub-path member and efficiently returns it to the magnetic core, it provides high signal voltage and a high Q value. With the magnetic sub-path member made of a soft-magnetic material having lower relative permeability than that of the magnetic core, the amount of magnetic fluxes passing through the magnetic sub-path member can be controlled to obtain a high S/N ratio by adjusting the cross section area ratio of the magnetic sub-path member to the magnetic core.

In the case of a radio-controlled timepiece containing the antenna of the present invention in a metal housing, decrease in sensitivity and a Q value by the metal housing, and the radiation of magnetic fluxes by resonance current are suppressed, thereby achieving high effective sensitivity. Also, the use of a magnetic sub-path member made of a flexible magnetic composite can provide a high-sensitivity antenna without design restriction because of high degree of design and ease of assembling. Such antennas are suitable for small, high-performance, radio-controlled timepieces (particularly, radio-controlled wristwatches), keyless entry systems, RFID systems, etc.

What is claimed is:

1. An antenna comprising a magnetic main-path member comprising a coil wound around a magnetic core, and a magnetic sub-path member magnetically connected to said magnetic core for constituting a substantially closed magnetic path with said magnetic main-path member such that a high S/N ratio in the antenna is acheived by adjusting both a relative permeability ratio and a cross section area ratio of the magnetic sub-path member to the magnetic core based on a result of the measurement of an S/N ratio before and after connecting a magnetic sub-path member to the magnetic core, said antenna meeting the relation of $(S/N)_1>(S/N)_0$, wherein $(S/N)_1$ is a ratio of a signal voltage S obtained from said coil to a noise voltage N in this antenna, and $(S/N)_0$ is a ratio of a signal voltage S to a noise voltage N in an antenna having the same structure except for having no magnetic sub-path member.

2. The antenna according to claim 1, wherein said magnetic core is made of at least one selected from the group consisting of ferrite, amorphous alloys, magnetic, nanocrystalline Fe—Cu—Nb—Si—B alloys, and magnetic Fe—Si alloys.

3. The antenna according to claim 1, wherein said magnetic sub-path member is formed by a flexible magnetic composite comprising at least one selected from the group consisting of soft-magnetic ferrite powder, soft-magnetic metal powder and soft-magnetic metal flake, and a resin and/or a rubber.

4. The antenna according to claim 1, wherein said magnetic sub-path member has a lower specific permeability than that of said magnetic core.

5. The antenna according to claim 1, wherein said magnetic sub-path member has specific permeability of 1-100.

6. The antenna according to claim 1, wherein said magnetic sub-path member has a smaller cross section area than that of said magnetic core.

7. A radio-controlled timepiece comprising a metal housing, a movement, a non-metal cover and a rear metal cover, wherein it contains the antenna recited in claim 1.

8. The radio-controlled timepiece according to claim 7, wherein said antenna is disposed such that said magnetic sub-path member is positioned on the side of said housing.

9. The radio-controlled timepiece according to claim 7, wherein it is a radio-controlled wristwatch.

10. A keyless entry system comprising a transmitter and a receiver, wherein said transmitter and/or said receiver contain the antenna recited in claim 1.

11. An RFID system comprising an RFID tag, wherein said RFID tag contains the antenna recited in claim 1.

* * * * *